US006734826B1

(12) United States Patent
Dai et al.

(10) Patent No.: US 6,734,826 B1
(45) Date of Patent: May 11, 2004

(54) MULTI-BAND ANTENNA

(75) Inventors: Hsin Kuo Dai, Tu-Chen (TW); Lung-Sheng Tai, Tu-chen (TW); Hsien-Chu Lin, Tu-Chen (TW); Chia-Ming Kuo, Tu-Chen (TW)

(73) Assignee: Hon Hai Precisionind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/327,249

(22) Filed: Dec. 20, 2002

(30) Foreign Application Priority Data

Nov. 8, 2002 (TW) ..... 91217913 U

(51) Int. Cl.[7] ..... H01Q 1/38

(52) U.S. Cl. ..... 343/700 MS; 343/725; 343/741; 343/846

(58) Field of Search ..... 343/700 MS, 725, 343/741, 846, 848, 866

(56) References Cited

U.S. PATENT DOCUMENTS 6,002,367 A 12/1999 Engblom et al.
6,072,434 A 6/2000 Papatheodoron
6,204,819 B1 3/2001 Hayes et al.
6,295,029 B1 * 9/2001 Chen et al. ..... 343/700 MS
6,452,551 B1 * 9/2002 Chen ..... 343/700 MS
6,476,767 B2 * 11/2002 Aoyama et al. ..... 343/700 MS
6,498,586 B2 * 12/2002 Pankinaho ..... 343/700 MS
6,535,172 B2 * 3/2003 Hirabayashi ..... 343/725

OTHER PUBLICATIONS

Fang–I Hsu, "Planar Near–Field to Far–Field Transformation and PIFA Antenna Suitable for Wireless LAN", Paper of Institute of Communication Engineering National Chiao Tung University of Taiwan, 2001, http//datas.ncl.edu.tw/.

* cited by examiner

*Primary Examiner*—Tan Ho
(74) *Attorney, Agent, or Firm*—Wei Te Chung

(57) ABSTRACT

A multi-band antenna (1) for an electronic device comprises an insulative substrate (30), a feeder cable (40) and a conductive element disposed on the substrate including a radiating portion (21), a first connecting portion (22), a second connecting portion (23) and a ground portion (10). The radiating portion includes a plurality of radiating segments (211–218). The first and second connecting portions connect the ground portion with the radiating portion. A part of the radiating portion, the second connecting portion, the ground portion and the feeder cable form a planar loop antenna. The radiating portion, the first connecting portion, the ground portion and the feeder cable form a planar inverted-F antenna.

14 Claims, 9 Drawing Sheets

Scale: 5dBi/div
Operating Frequency 2.484 GHZ
Horizontally Polarized

Scale: 5dBi/div
Operating Frequency 2.484 GHZ
Vertically Polarized

Scale: 5dBi/div
Operating Frequency 5.35 GHZ
Horizontally Polarized

Scale: 5dBi/div
Operating Frequency 5.35 GHZ
Vertically Polarized

Scale: 5dBi/div
Operating Frequency 5.725 GHZ
Horizontally Polarized

Scale: 5dBi/div
Operating Frequency 5.725 GHZ
Vertically Polarized

MULTI-BAND ANTENNA

CROSS-REFERENCE TO RELATED APPLICATION

The present application is related to one contemporaneously and one previously filed U.S. patent applications having the same title, the same inventors and the same assignee with the invention.

BACKGROUND OF THE INVENTION

1. Field of the Invention

The present invention relates to an antenna, and in particular to an antenna fixed in an electronic device for receiving or transmitting signals in two distinct frequency bands.

2. Description of the Prior Art

The development of wireless local area network (WLAN) technology has been attended by the development of devices operating under the IEEE 802.11b standard (in the 2.45 GHz band) and the IEEE 802.11a standard (in the 5.25 GHz band). These devices benefit from a multi-band antenna. U.S. Pat. No. 6,204,819 discloses a conventional multi-band antenna. The multi-band antenna includes a first and second conductive branches 42, 46, and is provided for use within wireless communications devices, such as radiotelephones. A first conductive branch 42 has first and second feeds 43, 44 extending therefrom that terminate at respectively a first and second micro-electromechanical systems (MEMS) switches S1, S2. The second conductive branch 46 is in adjacent, spaced-apart relationship with the first conductive branch 42. One end of the second conductive 46 branch terminates at a third MEMS switch S3 and the opposite end of the second conductive branch 46 is connected to the first conductive branch 42 via a fourth MEMS switch S4. The fourth MEMS switch S4 is configured to be selectively closed to electrically connect the first and second conductive branches 42, 46 such that the antenna radiates as a loop antenna in a first frequency band. The fourth switch S4 is also configured to open to electrically isolate the first and second conductive branches 42, 46 such that the antenna radiates as an inverted-F antenna in a second frequency band different from the first frequency band. However, the switches add manufacturing cost and complexity to the antenna. Furthermore, the three dimensional structure of the antenna occupies a large space, which is counter to the trend toward miniaturization of portable electronic devices.

Hence, an improved multi-band antenna is desired to overcome the above-mentioned disadvantages of the prior art.

BRIEF SUMMARY OF THE INVENTION

A main object of the present invention is to provide a multi-band antenna occupying smaller space.

A multi-band antenna in accordance with the present invention comprises an insulative substrate, a conductive element disposed on the substrate, and a feeder cable connecting with the conductive element. The conductive element includes a ground portion, a radiating portion, a first connecting portion and a second connecting portion. The first and second connecting portions are adapted to connect the ground portion with the radiating portion. The radiating portion comprises a plurality of radiating segments connecting in turn and perpendicularly to each other. The feeder cable is a coaxial cable having an inner core conductor connecting with the radiating portion and a outer shield conductor connecting with the ground portion. The ground portion, a part of the radiating portion, the second connecting portion and the feeder cable form a loop antenna, which operates in a higher frequency band. The ground portion, the radiating portion, the first connecting portion and the feeder cable form a planar inverted-F antenna, which operates in a lower frequency band.

Other objects, advantages and novel features of the invention will become more apparent from the following detailed description of a preferred embodiment when taken in conjunction with the accompanying drawings.

DETAILED DESCRIPTION OF THE INVENTION

The present invention will now be described more fully hereinafter with reference to the accompanying drawings.

Figure 1:
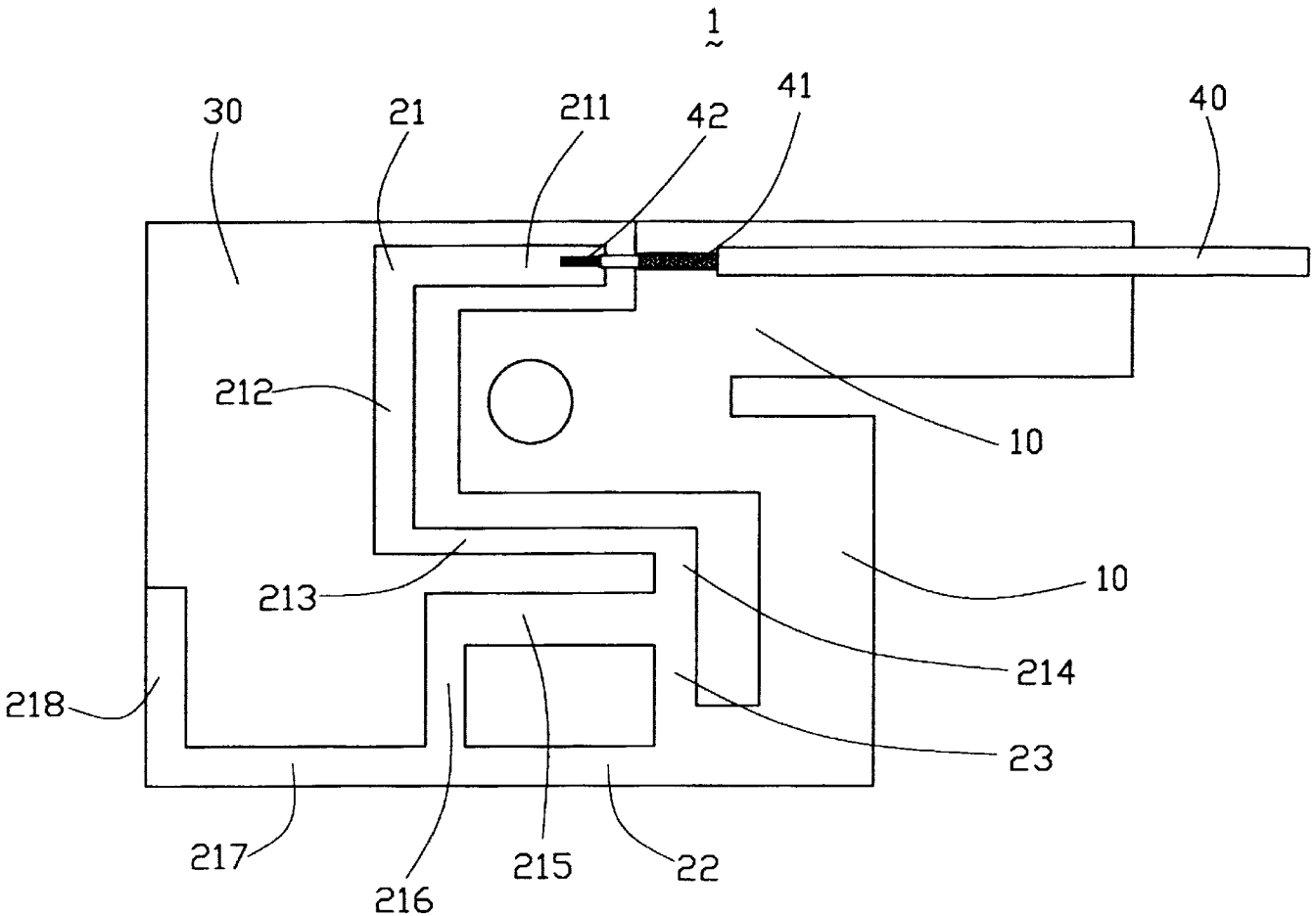
FIG. 1 is a plan view of a first embodiment of a multi-band antenna according to the present invention.

Referring to FIG. 1, a multi-band antenna 1 in accordance with a preferred embodiment of the present invention comprises a planar insulative substrate 30, a conductive element (not labeled) attached to the substrate 30 and a feeder cable 40 attached to the conductive element.

The conductive element can be a metal plate or a conductive layer disposed on one surface of the substrate 30 and includes a ground portion 10, a radiating portion 21 a first connecting portion 22 and a second connecting portion 23. The radiating portion 21 is a metal strip and includes a plurality of radiating segments 211–218 connected in turn, each perpendicular to the other. One end (not labeled) of the first connecting portion 22 connects to the radiating segments 216, 217, and the other end (not labeled) connects to the ground portion 10 and the second connecting portion 23. One end (not labeled) of the second connecting portion 23 connects to the radiating segments 214, 215, and the other end (not labeled) connects to the first connecting portion 22 and the ground portion 10. Thus the first and second connecting portions 22, 23 can provide different points of connection from the radiating portion 21 to the ground portion 10.

The coaxial feeder cable 40 includes an inner core conductor 42 surrounded by a dielectric layer (not labeled), which is surrounded by an outer shield conductor 41, which is surrounded by an outer jacket (not labeled). A portion of the jacket is stripped off to expose the outer shield conductor 41, and a portion of the outer shield conductor and the dielectric layer is stripped off to expose a length of the inner core conductor 42. The inner core conductor 42 is electrically connected to the radiating portion 21, and the outer shield conductor 41 is electrically connected to the ground portion 10.

The radiating segments 211–218, the first connecting portion 22, the ground portion 10, and the feeder cable 40 form a planar inverted-F antenna (not labeled) for receiving and transmitting lower frequency signals. The radiating segments 211–214, the second connecting portion 23, the ground portion 10, and the feeder cable 40 form a planar loop antenna (not labeled) for receiving and transmitting higher frequency signals.

Figure 2:
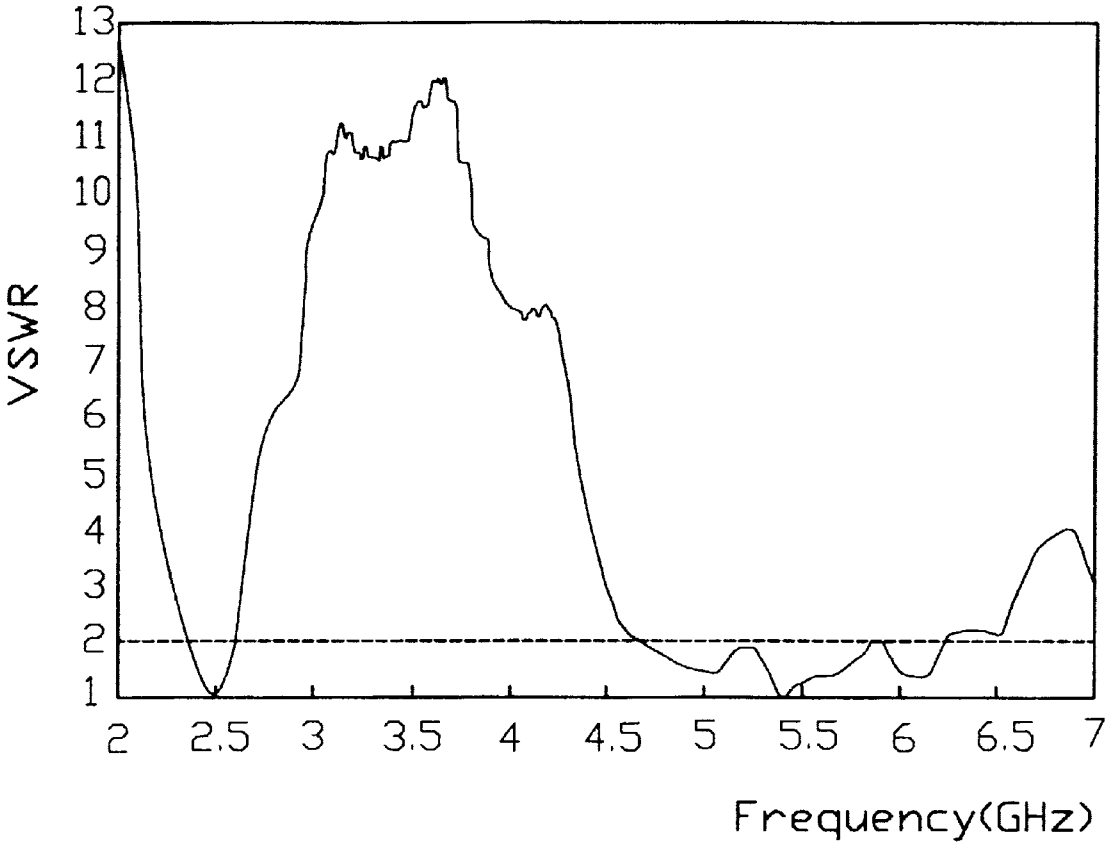
FIG. 2 is a test chart recording for the multi-band antenna of FIG. 1, showing Voltage Standing Wave Ratio (VSWR) as a function of frequency.
Figure 3:
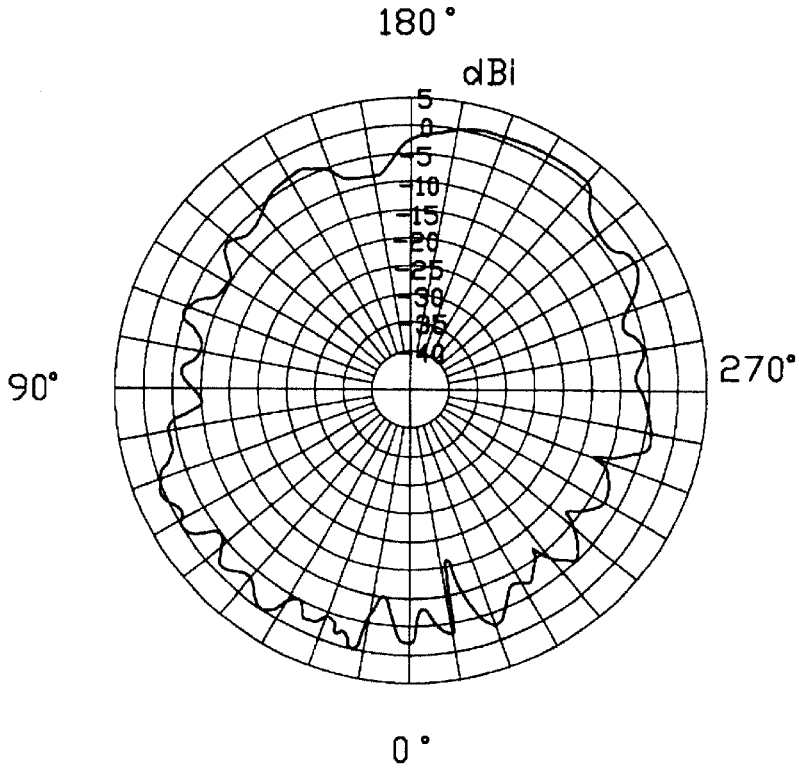
FIG. 3 is a horizontally polarized principle plane radiation pattern of the multi-band antenna of FIG. 1 operating at a frequency of 2.484 GHz.
Figure 4:
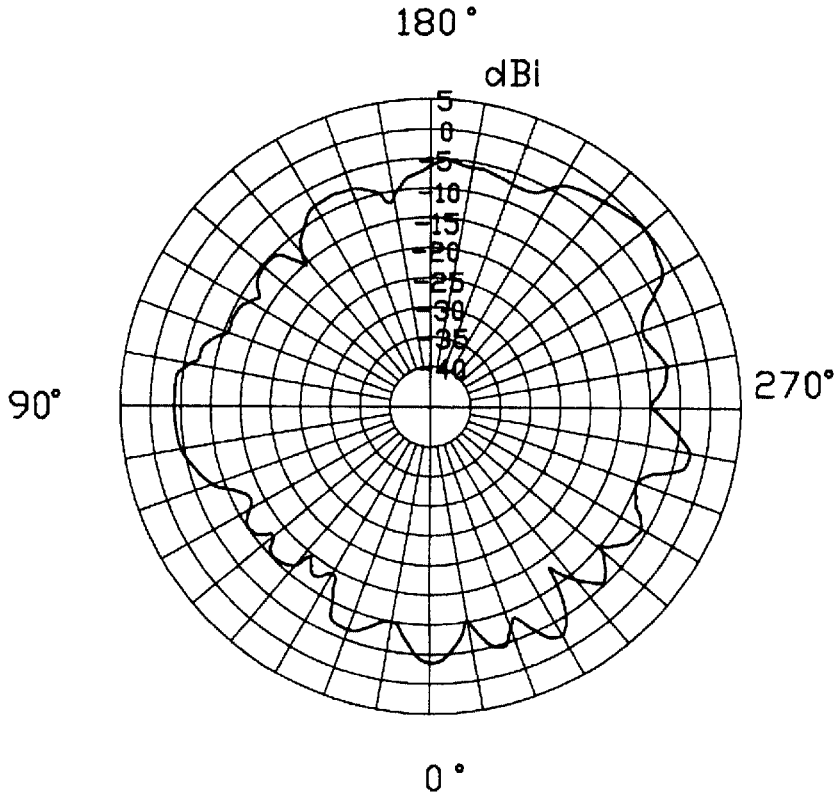
FIG. 4 is a vertically polarized principle plane radiation pattern of the multi-band antenna of FIG. 1 operating at a frequency of 2.484 GHz.
Figure 5:
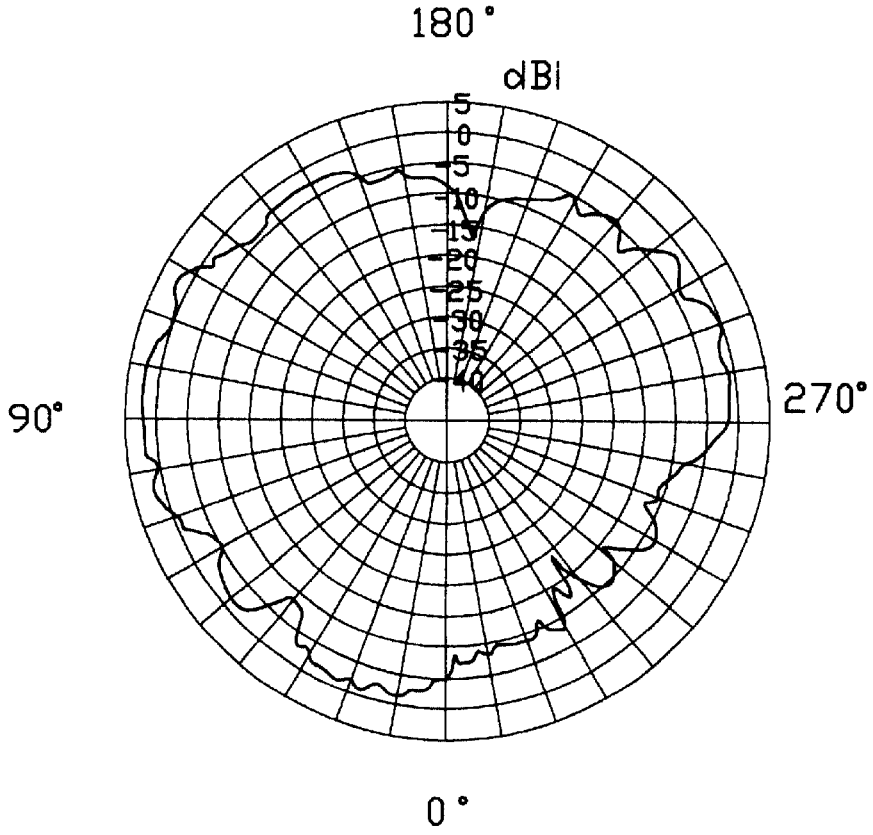
FIG. 5 is a horizontally polarized principle plane radiation pattern of the multi-band antenna of FIG. 1 operating at a frequency of 5.35 GHz.
Figure 6:
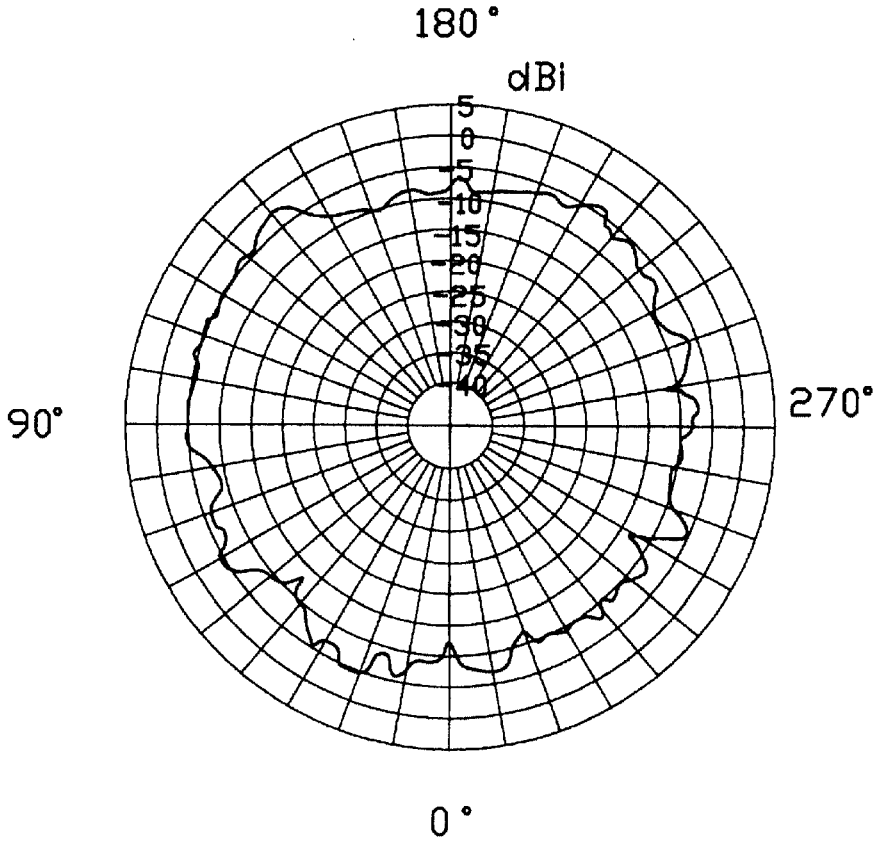
FIG. 6 is a vertically polarized principle plane radiation pattern of the multi-band antenna of FIG. 1 operating at a frequency of 5.35 GHz.
Figure 7:
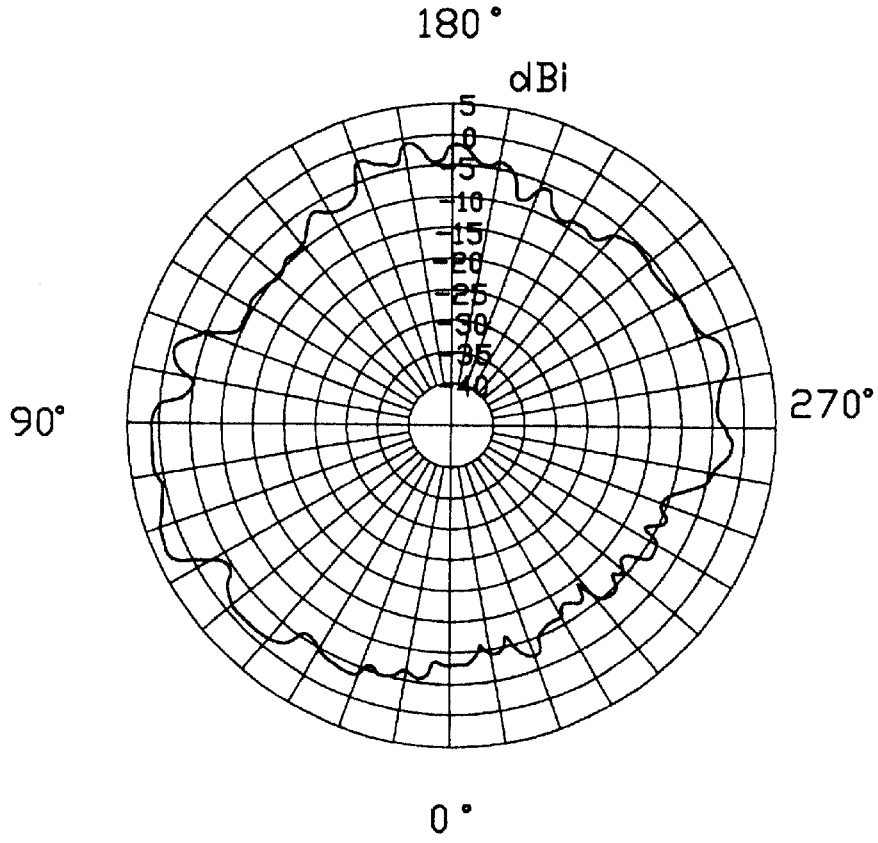
FIG. 7 is a horizontally polarized principle plane radiation pattern of the multi-band antenna of FIG. 1 operating at a frequency of 5.725 GHz.
Figure 8:
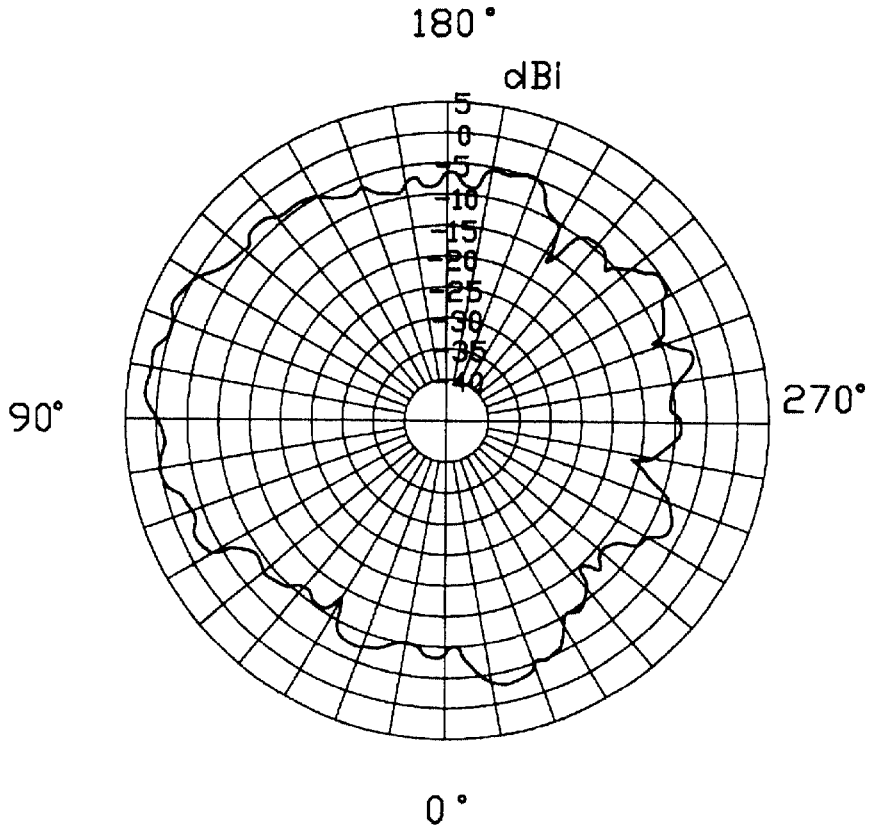
FIG. 8 is a vertically polarized principle plane radiation pattern of the multi-band antenna of FIG. 1 operating at a frequency of 5.725 GHz.

FIG. 2 shows a test chart recording of Voltage Standing Wave Ratio (VSWR) of the multi-band antenna 1 as a function of frequency. Note that VSWR drops below the desirable maximum value "2" in the 2.35–2.55 GHz frequency band and in the 4.68–6.25 GHz frequency band, indicating acceptably efficient operation in these two wide frequency bands, which cover more than the total bandwidth of the 802.11a and 802.11b standards.

Referring to FIGS. 3–8, the figures respectively show horizontally and vertically polarized principle plane radiation patterns of the multi-band antenna 1, which are tested respectively at the frequencies 2.484 GHz, 5.35 GHz and 5.725 GHz. Note that each radiation pattern is close to a corresponding optimal radiation pattern and there is no obvious radiating blind area.

Figure 9:
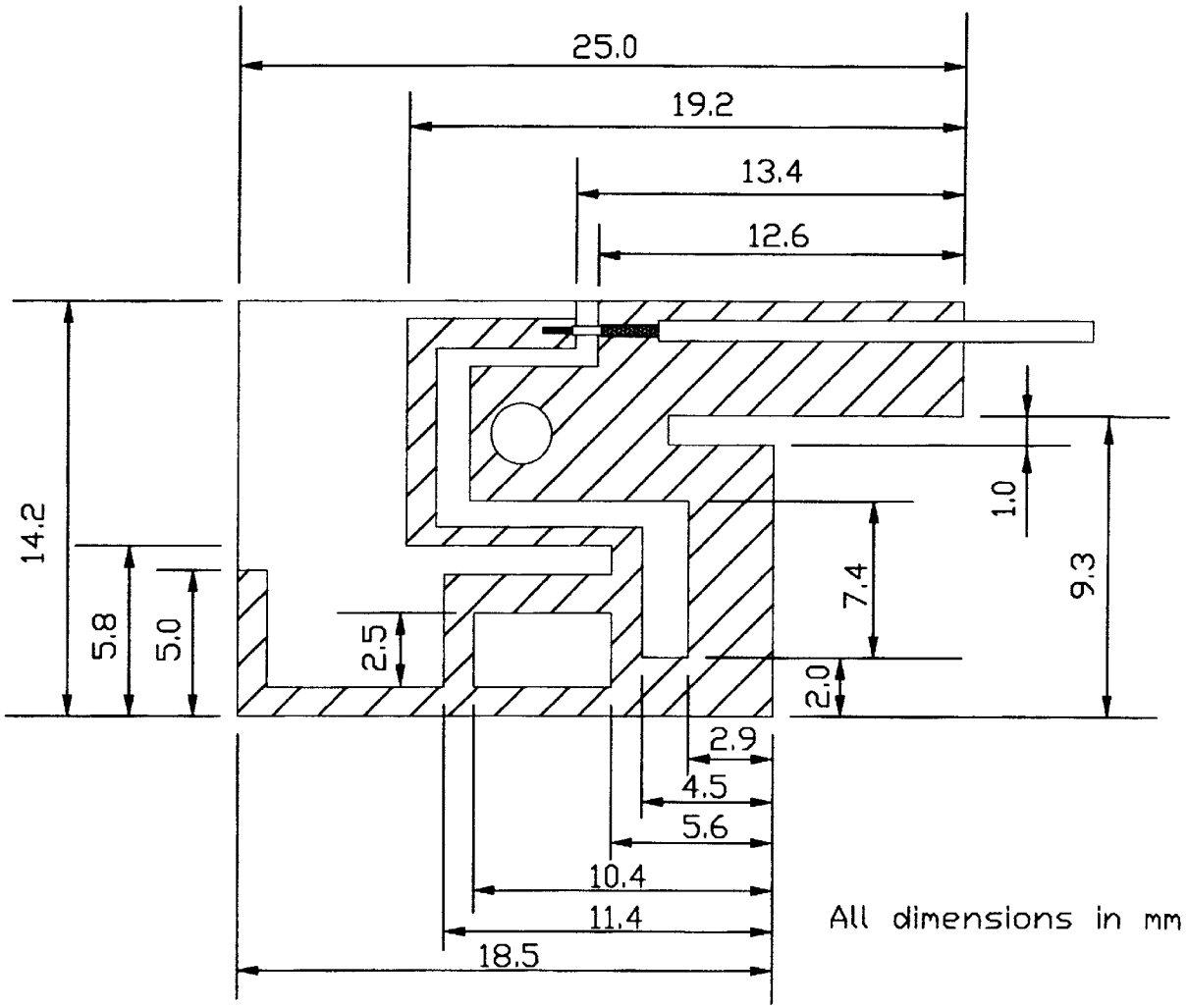
FIG. 9 is a plan view of the multi-band antenna of FIG. 1, illustrating some dimensions of the multi-band antenna.

Referring to FIG. 9, major dimensions of the multi-band antenna 1 are labeled thereon, wherein all dimensions are in millimeters (mm).

The planar structure of the multi-band antenna 1 of the present invention will occupy smaller space than three dimensional structures of the prior arts, which achieves an efficiency of miniaturization.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna adapted for use in a multi-band communication device, comprising:

an insulative substrate;

a conductive element disposed on the insulative substrate including a ground portion, a radiating portion and a first and second connecting portions for connecting the ground portion with the radiating portion; and a feeder cable connecting to the conductive element;

wherein the ground portion, the radiating portion, the first connecting portion and the feeder cable form a planar inverted-F antenna, and the second connecting portion, a part of the radiating portion, the ground portion and the feeder cable form a planar loop antenna.

2. The multi-band antenna as claimed in claim 1, wherein the radiating portion comprises a plurality of radiating segments.

3. The multi-band antenna as claimed in claim 2, wherein the plurality of radiating segments connect in turn end to end and are each perpendicular to the other segments to which they directly connect.

4. The multi-band antenna as claimed in claim 3, wherein the feeder cable includes an inner core conductor electrically connecting to the radiating portion and an outer shield conductor electrically connecting to the ground portion.

5. A multi-band antenna assembly comprising:

an insulative substrate defining a lengthwise direction and a transverse direction perpendicular to each other;

a conductive element area formed on the substrate, said conductive area including:

a ground portion;

a multiple-deflected-segment radiating portion with one end which is spaced from a first position of the ground portion along said lengthwise direction;

one set of connecting portion connecting said radiating portion to a second position of the ground portion; and a feed cable including an inner conductor secured to said end of the radiating portion, and an outer conductor secured to said first position.

6. The assembly as claimed in claim 5, wherein said one set of connecting portion includes first and second connecting segments with a common end connecting to said second position of the ground portion, and with two spaced opposite ends respectively connected to two different positions of a middle section of said radiating portion.

7. The assembly as claimed in claim 6, wherein said first and second connecting segments define a right angle configuration, and the middle portion intersected between said two spaced opposite ends of the first and second connecting segments also defines a complementary right angle configuration to cooperate with said right angle configuration to form a rectangle loop.

8. The assembly as claimed in claim 5, wherein said first position and said second position are opposite to each other in said transverse direction.

9. A multi-band antenna assembly comprising:

an insulative substrate defining a lengthwise direction and a transverse direction perpendicular to each other;

a conductive element area formed on the substrate, said conductive area including:

a ground portion;

a multiple-deflected-segment radiating portion with one end which is spaced from a first position of the ground portion along said lengthwise direction; and one set of connecting portion connecting said radiating portion to a second position of the ground portion; wherein:

said one set of connecting portion including first and second connecting segments with a common end connecting to said second position of the ground portion, and with two spaced opposite ends respectively connected to two different positions of a middle section of said radiating portion.

10. The assembly as claimed in claim 9, wherein said first and second connecting segments define a right angle configuration, and the middle portion intersected between said two spaced opposite ends of the first and second connecting segments also defines a complementary right angle configuration which cooperates with said right angle configuration to form a rectangle loop.

11. The assembly as claimed in claim 9, wherein said radiating portion defines a U-shaped contour extending from said end before intercepted by said connecting portion.

12. The assembly as claimed in claim 9, wherein said radiating portion defines an L-shaped contour extending from the other end thereof before intercepted by said connecting portion.

13. The assembly as claimed in claim 9, wherein an inner conductor of a feed cable is secured to said end.

14. The assembly as claimed in claim 13, wherein an outer conductor of said feed cable is secured to said ground portion.

* * * * *